United States Patent [19]

Martinez

[11] 4,165,798

[45] Aug. 28, 1979

[54] MUFFLER FOR INTERNAL COMBUSTION ENGINE

[76] Inventor: Ginez Martinez, 153 rue Anatole 93130 Noisy le sec, France

[21] Appl. No.: 892,136

[22] Filed: Mar. 31, 1978

[30] Foreign Application Priority Data

Jun. 30, 1977 [FR] France ..... 77 20124

[51] Int. Cl.[2] ..... F01N 1/08

[52] U.S. Cl. ..... 181/268; 181/282; 181/206

[58] Field of Search ..... 181/206, 238, 243, 264, 181/265, 274, 281, 203, 251, 253, 268, 275, 232, 403

[56] References Cited

U.S. PATENT DOCUMENTS

| | | | |
|---|---|---|---|
| 3,704,763 | 12/1972 | Becker et al. | 181/268 |
| 3,948,349 | 4/1976 | Bychinsky | 181/206 |

*Primary Examiner*—L. T. Hix
*Assistant Examiner*—Benjamin R. Fuller
*Attorney, Agent, or Firm*—Cushman, Darby & Cushman

[57] ABSTRACT

A muffler comprises a plurality of stackable stages 1, 2 and 3. Each stage is comprised of a phase opposition circuit. In each phase opposition circuit exhaust gases are divided into two paths towards an outlet where they are recombined. The difference in length between the two paths equals half a wavelength of a selected frequency.

13 Claims, 3 Drawing Figures

MUFFLER FOR INTERNAL COMBUSTION ENGINE

BACKGROUND OF THE INVENTION

This invention relates to a muffler for internal combustion engines or the like.

Various types of mufflers are known in the art, such as damper baffle type mufflers, resonance box mufflers, etc. In acoustic theory, there is also known a device called Koenig trombone which is normally used in laboratories or schools to carry out experiments on sound waves. A koenig trombone, as shown in FIG. 1, includes a bent stationary pipe 1 having two ports 2 and 3; a second bent pipe 4 can slide on the first one. In front of one of the ports, a tuning fork 5 is vibrated and the sound is listened at the other port while slowly sliding the movable pipe. Depending upon the positions of this movable pipe, maximum and minimum level sounds can be heard. Minimum level sounds occur when waves, having passed along pipe 1 and pipe 4 respectively, reach the port 3 in phase opposition, i.e. the path in the pipe 4 is the same as that in the pipe 1 plus a distance equal to an odd integer multiple of the half-wavelength of the sound wave coming from the tuning fork 5. So, when single frequency waves are in a phase opposition condition, a substantially full cancelling of the sound at the outlet of the device is obtained.

SUMMARY OF THE INVENTION

A main object of the present invention is to provide a muffler for internal combustion engines wherein noise damping is effected by phase opposition.

Another object of the present invention is to provide small size and low cost mufflers showing good noise damping properties and low pressure losses for internal combustion engines.

The applicant believes that such a utilization of Koenig trombones as mufflers has never been efficiently achieved. In fact, various problems should be solved for practical applications. Those problems especially include the following:

a Koenig trombone acts as a very selective noise damper and, as soon as adjusting conditions differ from phase opposition, the damping effect is considerably reduced;

the Koening trombone is a tunable device including a moving part, and adjusting it can be hardly carried out by a user;

in applications to mufflers, exhaust gas temperature greatly varies depending upon the engine speed (for example between ambient temperature and 200°C.). This gas exhaust temperature variation causes sound speed variation in the Koenig trombone and so a variation of the half-wavelength corresponding to a given frequency.

In the following description and the appending claims the term "phase opposition circuit" means a unit in which two paths are parallely disposed between an exahust gas inlet and an exhaust gas outlet, the difference of length between those two paths being equal to half a wavelength for a selected frequency. It is clear that those paths are only in such a condition for a particular frequency.

According to one aspect of the invention, there is provided two phase opposition circuits in series, a common path for recombining exhaust gases being insured between said circuits.

Accordingly, the present invention provides a process to reduce noise of an internal combustion engine comprising the steps of determining a frequency at which a substantial sound power is produced; dividing exhaust gases between first and second paths of a different length, such length difference corresponding to half a wavelength for said frequency; recombining exhaust gases flowing from each path; passing recombined gases along a common path, the length of which is higher than a predetermined limit; dividing again exhaust gases between a third and a fourth path, the difference of length between said paths being substantially equal to the difference of length between the first and the second paths. Further phase opposition stages can be serially added to the first and second stages.

While the series of phase opposition circuits separated from each other by a common path can be worked out according to any manner known to those skilled in the art, preferred embodiments obtained by stamping will be described hereafter.

It will be noted that using successive phase opposition circuits shows an important advantage as compared to conventional mufflers. In fact, gases flowing through such phase opposition circuits do not theorically present pressure losses. Therefore, paths for gas flowing will be preferably of a streamlined shape so as not to produce any vortex, i.e. more particularly without any marked corners and sharp angles.

BRIEF DESCRIPTION OF THE DRAWINGS

For a better understanding of the invention as well as other and further features thereof, reference is made to the following description which is to be read in conjunction with the following figures wherein.

DESCRIPTION OF THE PREFERRED EMBODIMENTS

Figure 2:
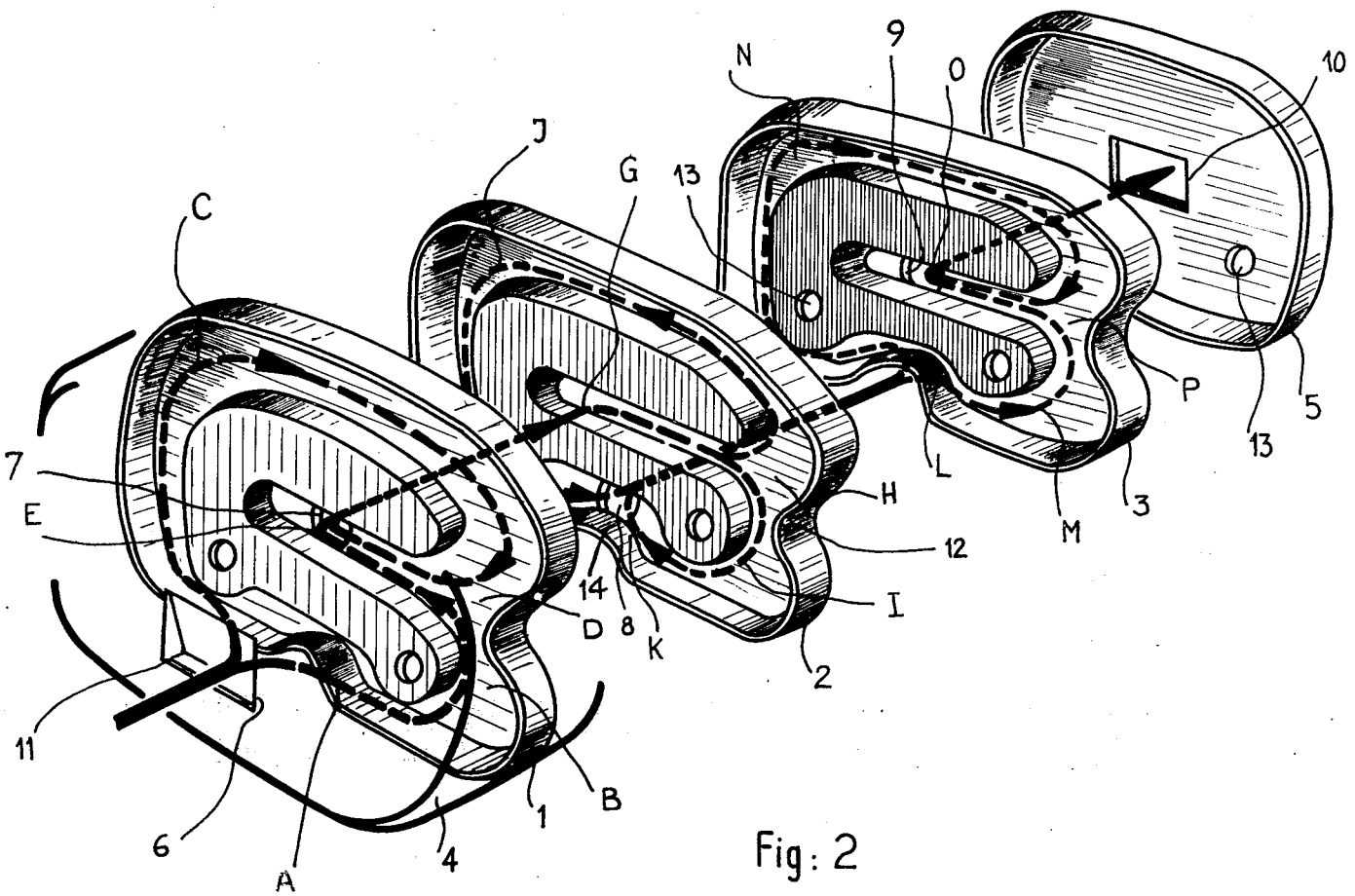
FIG. 2 is an exploded perspective view showing a muffler in accordance with the invention.

Referring now to FIG. 2, there is disclosed three phase opposition circuits 1, 2 and 3 placed in a case 4 closed by a cover 5. Each of the phase opposition circuit elements is made by stamping a metal plate and defines three walls for gases with a substantially rectangular cross-section, the gas paths being closed by applying one element against the next one or against the case bottom.

Exhaust gases enter the muffler in accordance with the present invention through an inlet 6 provided in the bottom of the case 4 so as to reach the area A of the first phase opposition circuit element 1. Gases then divide to flow towards the area D through paths ABD and ACD as shown in FIG. 2. The recombined gases in area D then flow towards outlet 7 of first stage 1. Therefore, those recombined gases follow the same common path DE, before entering the next stage, E being the area close to the outlet 7. The next stage 2, apart from the position of the outlet 8, is substantially similar to the stage 1. Gases first flow along a common path GH before going towards the outlet 8, in area k, following paths HIK and HJK of different lengths.

Stages 1 and 2 including two phase opposition circuits placed in series and separated from each other by a common path DEGH are in most cases sufficient so as to effect a substantial reduction in noise of exhaust gases from an internal combustion engine. Nevertheless, as the stages can be very easily stacked according to the present invention, the number of stages could be consequently increased. As an example, FIG. 2 shows an additional stage 3 substantially similar to stage 1 and including an outlet 9. Gases enter area L and flow towards the outlet area O through paths of different lengths LMO and LNO. Finally, the case cover 5 includes an outlet 10 which communicates with the outlet 9 of the last stage.

The foregoing description essentially relates to the working of a muffler in accordance with the present invention. The concrete design of each stage is quite clear in FIG. 2. Each stage is carried out by means of metal plate stamping, so as to include sidewalls and a centrally projecting portion; the lower part of the plate, the sidewall thereof and the sidewalls of the centrally projecting portion form three sides of the gas path, the fourth side being closed as previously described by stacking stages against one another and against the case. It is clear that this stamping process only constitutes a preferred embodiment of the present invention and the sidewalls forming the gas passage could be made for example by welding the edge of a transverse strip portion onto a plate.

In the preferred embodiment, the centrally projecting portion is substantially U shaped and gases enter or depart on one U branch side, substantially at the middle thereof, while they depart or enter at the center of the U.

The various stages, the case and the cover are provided with holes 13 which are used to tighten the muffler after assembly.

Referring again to FIG. 2, it will be noted that the various paths of exhaust gases are provided in such a way that such gases are never suddenly interrupted as would be the case when flowing in sharp angled paths. In this purpose, all elbows are rounded; and, at the various outlets and passages from one stage to another, it is preferably provided with reflecting means such as the one indicated by reference 11 at the inlet. Similarly, recesses in sidewalls such as those generally indicated at 12 and 14 in the stage 2 help in dividing and combining exhaust gases, respectively, without introducing any vortex.

The cross-section area of the various paths is such that it is always higher than or equal to the cross-section area of the exhaust gas outlet at the exhaust manifold of the internal combustion engine. For example, the common paths DE, HG, OP have substantially the same cross-section area as the inlet 11 and the various communicating holes between stages. On the other hand, the cross-section area of paths in which only half exhaust gases are flowing, such as paths ABD, ACD, HIK, HJK, LMT and LNT will be substantially equal to or higher than half of the exhaust gas outlet.

Tests of a muffler in accordance with the present invention have been carried out using the internal combustion engine of a hand cross-cutting saw. Such a muffler effected a reduction of the overall sound level greater than 12 dB as compared to a free exhaust engine. On the other hand, the loss of power was only a few percent. In the above mentioned tests, stages 1 and 2 were adjusted at a 1460 hertz frequency, which corresponds to wavelengths of 26, 27, 29 and 31 cm respectively at the temperatures of 80°, 100°, 150° and 180° C. The length of paths DE and GH was substantially equal to 2.5 cm and it will be noted that the total length DE+GH of the common path is substantially in the region of the difference between previously cited minimum and maximum wavelengths. In any case, various tests showed that the distance between the recombination area D of the first phase opposition circuit and the division area H in the second phase opposition circuit would have to be for such engines higher than about 4 cm. Although the assignee does not intend to give any theoritical explanation as to the operation of the muffler in accordance with the present invention, it will be noted that it is essential to provide a common path between the successive phase opposition circuits. The length of such a common path will be easily determined by those skilled in the art in each particular case, as a noise minimum is clearly observed as soon as this length is higher than a minimum level which can be easily determined practically.

Figure 1:
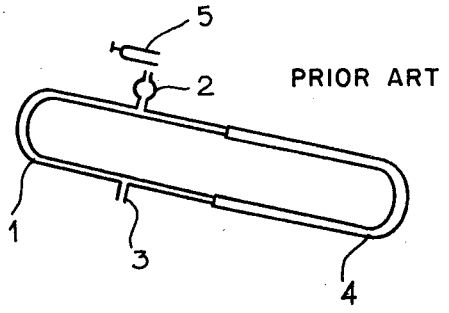
FIG. 1 is a view showing a Koenig trombone.
Figure 3:
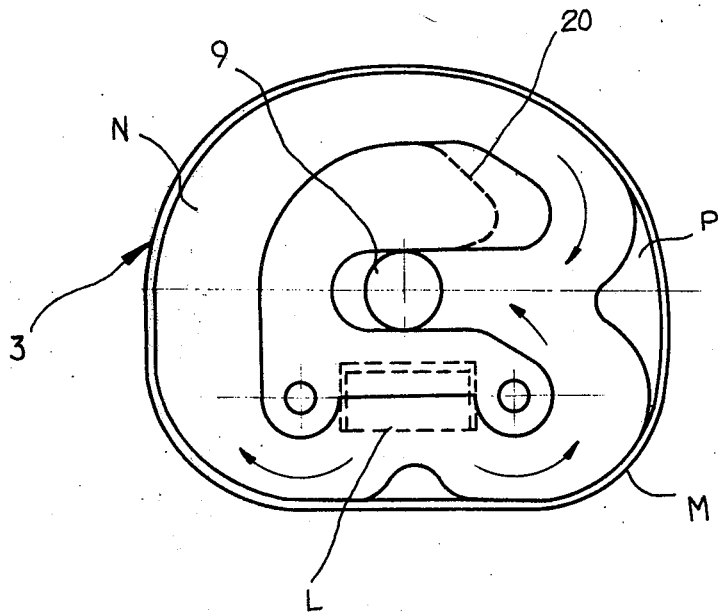
FIG. 3 is a view showing a modification of the invention.

In the particular case of the above mentioned tests, the third phase opposition circuit 3 was adjusted at the same wave-length as the precedent stages. However, it will be noted that, while maintaining the same external shape for stage 3, the shape of the projection portion can be altered and therefore the frequency corresponding to a phase opposition can be modified. FIG. 3 shows a top view of stage 3 in full line. The dotted line 20 shows a way to alter the projecting portion of this stage in order to adjust the wavelength thereof. Of course, this is only shown as an example in order to illustrate that adjusting the tuning frequency of a stage can be carried out without changing the external shape of said stage.

Another way to alter the tuning frequency of a stage is to change the place of, or to sidely enlarge, the gas inlet of the gas outlet provided in the peripheral area of the plate.

It will be also noted that, when a phase opposition circuit is adjusted for a given frequency (for example 1460 hertz), it is also adjusted for the odd harmonics of said frequency (for example 4380 hertz, 7300 hertz, etc.).

While the examplary embodiments described herein are presently considered to be preferred, various other modifications or improvements will be apparent to those skilled in the art.

What is claimed is:

1. An exhaust gas noise silencing process for exhaust gas stream of an internal combustion engine, including the steps of:

determining a frequency at which a particularly loud exhaust gas sound level is obtained from the internal combustion engine exhaust gas stream;

admitting the exhaust gas stream to a first phase opposition circuit in which the stream divides into two components that travel along two different paths which differ from one another in length by about half a wavelength corresponding to said frequency;

recombining the two components at the downstream end of the first phase opposition circuit and passing the recombined stream along a path having at least a predetermined minimum length;

at the downstream end of this latter path, admitting the exhaust gas stream to a second phase opposition circuit in which the stream again divides into two components that travel along two different paths which differ from one another in length;

again recombining the two components at the downstream end of the second phase opposition circuit, thereby constituting a quieter exhaust gas stream.

2. The process of claim 1, further including:

passing said quieter exhaust gas stream along a path having at least a predetermined minimum length;

at the downstream end of this latter path, admitting said quieter exhaust gas stream to a third phase opposition circuit in which this stream divides into two components that travel along two different paths which differ from one another in length by about half a wavelength corresponding to said frequency.

3. The process of claim 1, wherein:

in said second phase opposition circuit, the two components of said exhaust gas stream are conducted along the respective said two different paths, which differ from one another in length by about half a wavelength corresponding to said frequency.

4. The process of claim 1, wherein:

said frequency is determined when said sound level is at the maximum attained in operation of the internal combustion engine.

5. The process of claim 1, wherein:

the internal combustion engine is one which typically operates over a range of exhaust gas stream outlet temperatures so that said frequency equates to a corresponding range of wavelengths, and said step of determining is made when the exhaust gas stream outlet temperature is near the low end of said range.

6. The process of claim 1, wherein:

the internal combustion engine is one which typically operates over a range of exhaust gas stream outlet temperature so that said frequency equates to a corresponding range of wavelengths;

the path along which said recombined stream is passed at the downstream end of said first phase opposition circuit has a minimum length substantially equating to the difference between the minimum and maximum wavelengths in said corresponding range of wavelengths.

7. The process of claim 1, further comprising:

determining by sensing sound output between the downstream end of the first phase opposition circuit and the upstream end of the second phase opposition circuit that length of path along which said recombined stream is passed at the downstream end of said first phase opposition circuit for which said sound output is minimised, and providing this path to have such a length.

8. An exhaust gas noise silencing process for an internal combustion engine including the steps of:

determining a frequency at which a particularly high sound level is obtained, dividing exhaust gases into a first and a second path, the length of said paths being different by half a wavelength corresponding to said frequency, recombining the exhaust gases flowing from each of said paths, passing said recombined gases along a common path with a length higher than a predetermined limit, dividing again said exhaust gases into a third and a fourth path, the difference in length between said third and fourth paths being substantially equal to the difference in length between said first and second paths, and recombining the exhaust gases flowing from said third and fourth paths.

9. An exhaust gas noise silencing device for an exhaust gas stream of an internal combustion engine which when operating within an operating temperature range produces sound in its exhaust gas stream of a particularly high amplitude centered about a particular sound frequency, said device being a muffler, comprising:

conduit means providing a first and a second phase opposition circuit of the Koenig trombone-type, although not essentially flow path length adjustable, connected in series by a segment of conduit having at least a predetermined minimum length substantially equating to the difference between the minimum and maximum wavelengths of said particularly high amplitude sound at the opposite extremes of said operating temperature range;

said conduit means including an inlet to said first phase opposition circuit and an outlet from said second phase opposition circuit, said muffler comprising at least two stacked stage plates and a cover plate stacked therewith against one of said stage plates;

said conduit means being defined as a plurality of surface channels provided upon said stage plates, and surface means of said cover plate cooperating with at least one of said surface channels; and securement means holding the stacked cover plate and stage plates together as a unit.

10. The device of claim 9, wherein:

each stage plate comprising a generally U-shaped central island having two legs, said central island axially protruding in one sense, and an outer perimetrical flange axially projecting in said one sense, said surface channel means of such stage plate being provided laterally between said central island and said outer perimetrical flange and between said two legs;

alternating ones of said at least two stacked stage plates having an opening axially through within said surface channel means thereof between the respective said legs and between one of the respective said legs and the respective outer perimetrical flange; one of said inlet and said outlet being provided as an opening through said cover plate.

11. The device of claim 10, wherein:

each of said stage plates is of generally rounded-corner rectangular figure in plan.

12. The device of claim 11, wherein:

said muffler is designed to be fitted to an engine exhaust manifold of a particular transverse cross-sectional area by having said conduit means thereof, in all common flow path portions thereof be substantially the same in transverse cross-sectional area as said particular transverse cross-sectional area, and by having said conduit means thereof in all divided flow path portions thereof each be of substantially half said particular transverse cross-sectional area.

13. The device of claim 9, wherein:

the securement means comprises a second cover plate cooperating with the first described cover plate to encase said stage plates between them; and means clamping said cover plates together, with said inlet being provided through one of said cover plates and said outlet being provided through the other of said cover plates.

* * * * *